US009126742B2

(12) United States Patent
Elliott et al.

(10) Patent No.: US 9,126,742 B2
(45) Date of Patent: Sep. 8, 2015

(54) NOVELTY DISPENSER

(75) Inventors: Todd S. Elliott, Portland, OR (US); Zack Maffie, Portland, OR (US)

(73) Assignee: Radz Brands LLC, Portland, OR (US)

( * ) Notice: Subject to any disclaimer, the term of this patent is extended or adjusted under 35 U.S.C. 154(b) by 128 days.

(21) Appl. No.: 13/579,892

(22) PCT Filed: Feb. 25, 2011

(86) PCT No.: PCT/US2011/026221

§ 371 (c)(1), (2), (4) Date: Aug. 20, 2012

(87) PCT Pub. No.: WO2011/106631

PCT Pub. Date: Sep. 1, 2011

(65) Prior Publication Data

US 2012/0312834 A1 Dec. 13, 2012

Related U.S. Application Data

(60) Provisional application No. 61/308,216, filed on Feb. 25, 2010.

(51) Int. Cl.
*G07F 11/00* (2006.01)
*A24F 15/04* (2006.01)
(Continued)

(52) U.S. Cl.
CPC ..... *B65D 83/0409* (2013.01); *B65D 81/365* (2013.01); *B65D 83/04* (2013.01)

(58) Field of Classification Search
CPC ... B65D 83/0409; B65D 83/04; B65D 81/365
USPC ..... 221/1, 229, 24, 289, 241, 59.2, 250
See application file for complete search history.

(56) References Cited

U.S. PATENT DOCUMENTS 2,470,993 A 5/1949 Kramer
2,506,719 A * 5/1950 Gregg ..... 221/24
(Continued)

FOREIGN PATENT DOCUMENTS

EP 1411004 1/2011
GB 2299983 A * 10/1996 ..... B65D 83/04
(Continued)

OTHER PUBLICATIONS

English translation of office action in CN counterpart patent application No. 201180011297.6; Mar. 5, 2014; 10 pages.
(Continued)

*Primary Examiner* — Rakesh Kumar
(74) *Attorney, Agent, or Firm* — Hancock Hughey LLP

(57) ABSTRACT

A novelty dispensing apparatus includes a housing in which novelty items are contained and a receptacle mounted inside the housing and movable from a retracted position within the housing, though an opening in the housing and into an extended position, wherein part of the receptacle member protrudes from the housing. A door is mounted for movement adjacent to the opening from a closed position to an open position that enables the receptacle member to protrude from the opening. A link member is mounted for movement within the housing and is attached to the door and at another end to the receptacle member. The link member has a handle for manipulation, wherein manipulation of the handle moves the link member and attached door and receptacle member. The dispenser includes lost-motion mechanisms.

17 Claims, 20 Drawing Sheets

(51) Int. Cl.
*B65D 83/04* (2006.01)
*B65D 81/36* (2006.01)

(56) References Cited

U.S. PATENT DOCUMENTS

| | | | | | |
|---|---|---|---|---|---|
| 2,514,450 | A * | 7/1950 | Kopf | 446/270 |
| 3,660,930 | A * | 5/1972 | Indjian | 446/297 |
| 4,311,251 | A * | 1/1982 | Sternberg | 221/24 |
| 4,501,379 | A * | 2/1985 | Halone et al. | 221/221 |
| 4,700,869 | A * | 10/1987 | Bogner | 221/229 |
| 4,805,344 | A * | 2/1989 | Hrboka | 49/280 |
| 5,356,035 | A * | 10/1994 | Shlopak et al. | 222/78 |
| 5,388,723 | A * | 2/1995 | Kampmeyer | 221/186 |
| 5,531,355 | A * | 7/1996 | Ullmann et al. | 221/191 |
| 5,651,475 | A * | 7/1997 | Fenton | 221/24 |
| 6,129,608 | A * | 10/2000 | Prichard et al. | 446/475 |
| 6,267,639 | B1 * | 7/2001 | Menow et al. | 446/81 |
| 6,279,684 | B1 * | 8/2001 | Lewis | 186/36 |
| 6,299,015 | B1 * | 10/2001 | Hasan et al. | 221/24 |
| 6,425,495 | B1 | 7/2002 | Senda | |
| 6,499,625 | B1 * | 12/2002 | Mendillo et al. | 221/24 |
| 6,564,967 | B1 * | 5/2003 | Stringfield et al. | 221/229 |
| 6,644,503 | B2 * | 11/2003 | Peterson | 221/155 |
| 6,889,869 | B2 * | 5/2005 | Hallin | 221/223 |
| 6,966,451 | B2 | 11/2005 | Weiss | |
| 7,036,681 | B2 * | 5/2006 | Suda et al. | 221/210 |
| 7,156,256 | B2 * | 1/2007 | Senda et al. | 221/172 |
| 8,651,322 | B2 * | 2/2014 | Fung | 221/24 |
| 8,944,282 | B2 * | 2/2015 | Kroupa et al. | 221/185 |
| 2002/0108961 | A1 * | 8/2002 | Nakamoto et al. | 221/24 |
| 2009/0207690 | A1 * | 8/2009 | Curtis et al. | 366/198 |
| 2010/0065577 | A1 * | 3/2010 | Coughlin et al. | 221/277 |
| 2012/0201093 | A1 * | 8/2012 | Curtis et al. | 366/213 |
| 2012/0312834 | A1 * | 12/2012 | Elliott et al. | 221/1 |
| 2013/0264760 | A1 * | 10/2013 | Johnson et al. | 269/89 |

FOREIGN PATENT DOCUMENTS

| | | | |
|---|---|---|---|
| GB | 2299983 | | 1/2011 |
| GB | 2470993 | B * | 9/2011 |
| WO | WO 02063983 | A1 * | 8/2002 |

OTHER PUBLICATIONS

European Supplementary Search Report in counterpart EP patent application No. EP 11 74 8137; Mar. 11, 2015; 5 pages.

* cited by examiner

NOVELTY DISPENSER

BACKGROUND AND SUMMARY

This invention relates to a dispenser for novelty items.

There exists in the prior art multiple forms of devices that are operable for dispensing edible and non-edible items. Examples of such items include snacks, gum, mints, vitamins, capsules, beads, toys, etc. For the purposes of this description, such items will be referred to as novelty items.

Desirable features of novelty dispensers include compactness, efficient and robust operation, as well as interesting shapes and ornamentations.

The present invention is directed to a dispenser that includes mechanisms for meeting those desirable design features.

DETAILED DESCRIPTION

Figure 1:
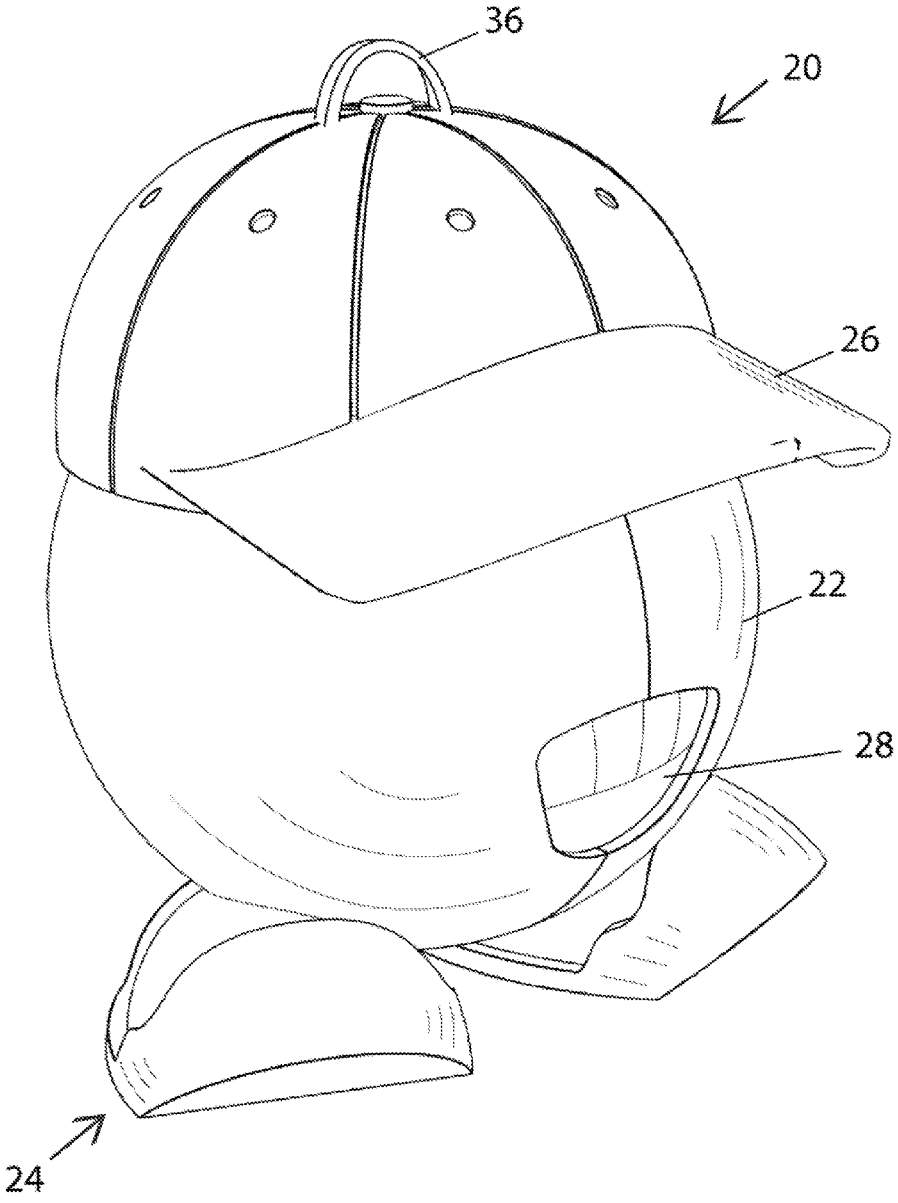
FIG. 1 is a view of the exterior of one embodiment of an assembled novelty dispenser in a position whereby the receptacle for dispensing the novelty is retracted within the dispenser.
Figure 2:
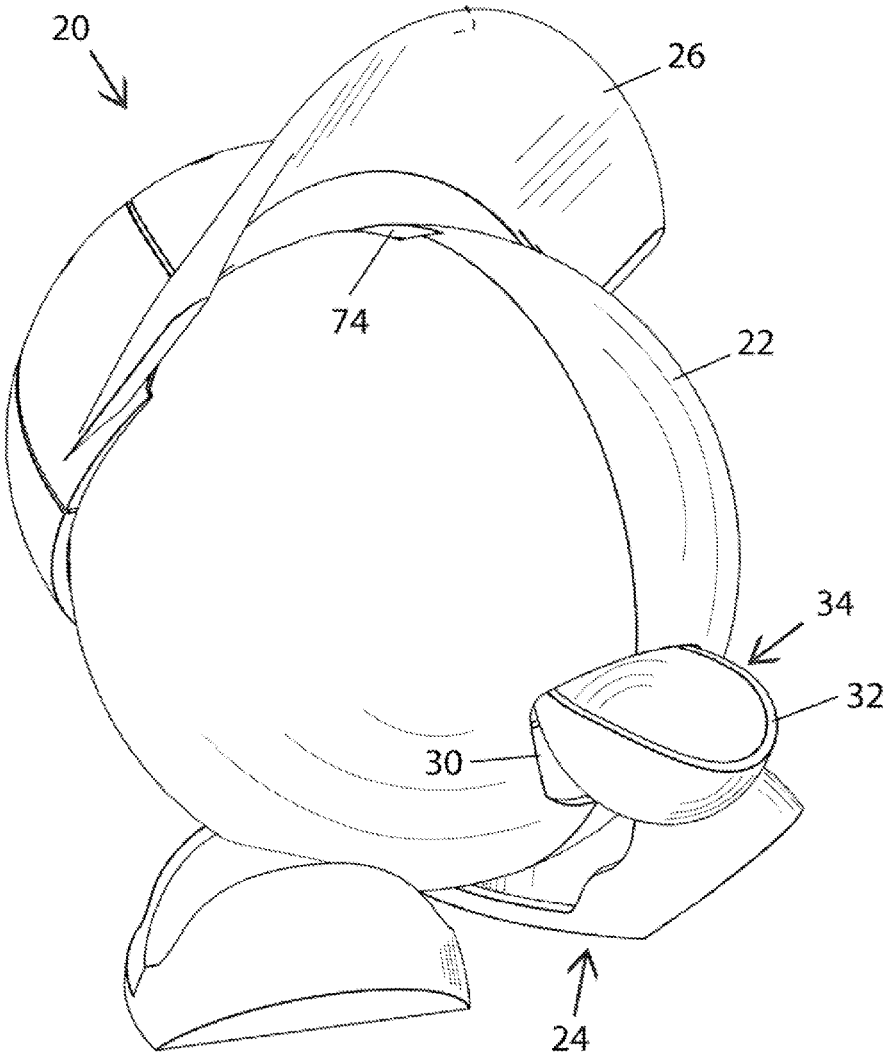
FIG. 2 is a view of the exterior of an assembled novelty dispenser in a position whereby the receptacle for dispensing the novelty is extended to protrude from the dispenser interior chamber.

With reference to FIGS. 1 and 2, the novelty dispenser 20 of the present invention includes a housing 22, which in this embodiment is a thin-walled, plastic, spherical member.

The housing is supported by a base 24, which in this embodiment is configured as two cartoon-like feet. The base 24, which can be formed with or attached to the housing 22, is shaped with a flat underside so that the dispenser 20 can stably stand on a horizontal surface.

Atop the housing 22 is a handle 26 for operating the dispenser. In this embodiment, the handle is configured as a baseball cap. The handle 26 is fastened to the internal components of the housing, as described more below, and is movable from a closed position (FIG. 1) to a dispense position (FIG. 2). When the handle 26 is moved into the dispense position, the dispenser operates to raise a door 28 (FIG. 1) to reveal an opening 30 (FIG. 2) in the housing wall through which extends a bowl-shaped part 32 of a receptacle member 34 that carries one or more novelty items, such as a piece of candy (not shown), for the user to take.

It is noteworthy here that in addition to or instead of the base 24, the dispenser 20 can be configured to be hung from a key ring or the like and, to this end, a loop 36 is formed in the dispenser, preferably in the handle 26.

Figure 4:
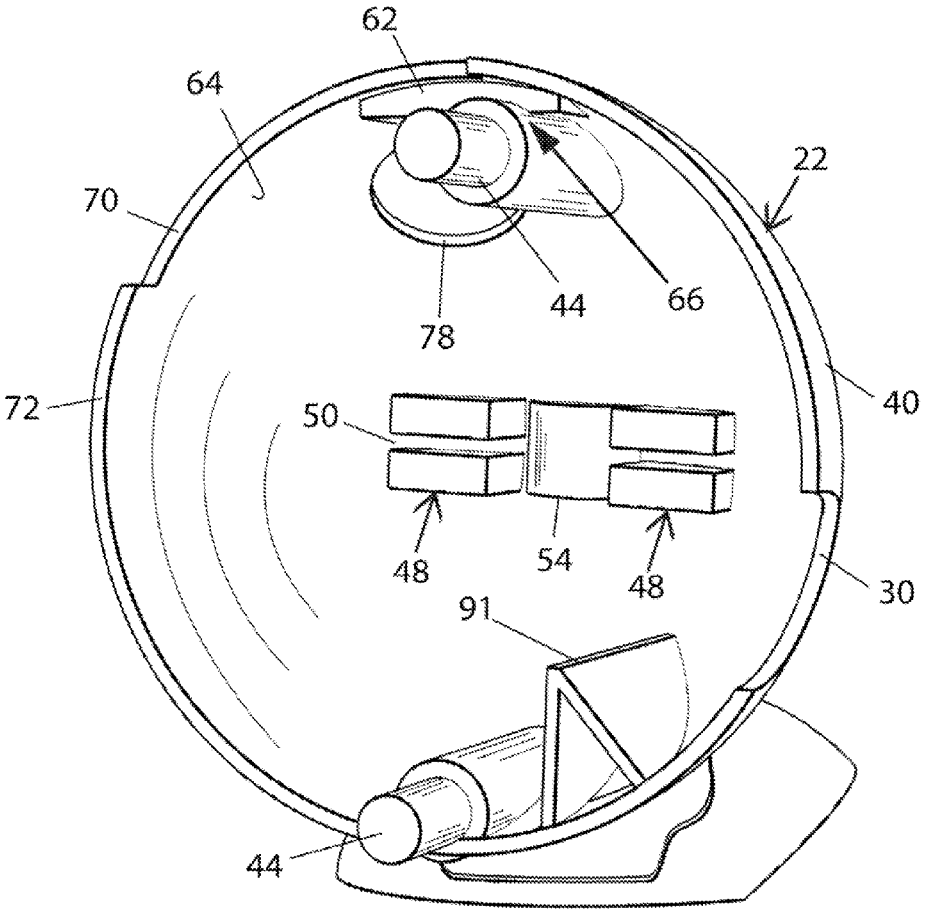
FIGS. 4 and 5 are views of two halves of the dispenser housing with many internal components removed.
Figure 5:
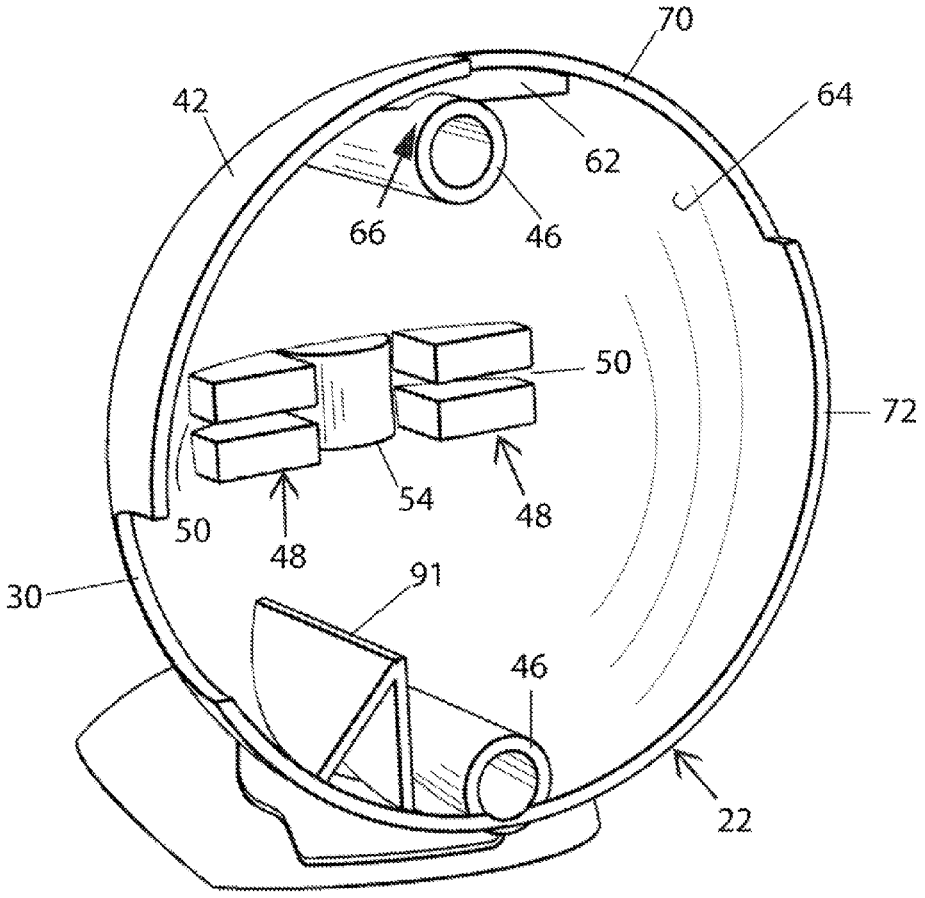

With reference to FIGS. 4 and 5, the housing 22 may be formed in a number of ways, including by injection molding of two halves that are subsequently joined together with the internal components (described below) contained inside. In one embodiment, one housing half-segment 40 (FIG. 4) is essentially a mirror image of the other half-segment 42 (FIG. 5), except that one segment 40 is formed with two or more protruding coupling pegs 44 that fit into the hollow interior of cylindrical coupling sleeves 46 formed in the other segment 42. Other means for attaching together the two housing segments may be used.

Inside each housing segment 40, 42 there is formed a pair of spaced-apart brackets 48. Each of the pair of brackets defines a groove 50 into which fits a thin, horizontal support plate 52 (FIG. 6) that is contained within the housing as described more below. In one embodiment, a rounded boss 54 is located in the space between each pair of brackets 48. The boss 54 fits into a correspondingly shaped notch 56 cut in each side of the support plate 52. The boss 54 and notch engagement secures the support plate 52 against movement when the support plate is in place inside the housing.

In a preferred embodiment, the housing interior is formed with a guide member that is comprised of two guide surfaces 62 between which slides a thin, flexible link member 80 as described more fully below. The guide member surfaces 62 are arranged to define between them a gap 66, generally centered in the assembled housing and through which gap slides the link member 80 (See FIGS. 3A and 3B). The gap 66 is located between one of the cylindrical sleeves 46 and the curved interior surface 64 of the housing. The gap is sized to permit the thin, generally flat link member 80 to slide easily through the gap without twisting.

With continued reference to FIGS. 4 and 5, the housing segments 40, 42 are both formed with an elongate, rectangular recess 70 in the edge of the housing segment and that extends from a location near the top of the housing 22 continuously along part of the back side 72 (the hidden side in FIGS. 1 and 2) of the housing. When the housing segments are assembled together, the combined recesses 72 form an elongate slot 74 in the housing, through which protrudes a post 76 (FIGS. 3A and 3B) that is attached to the link member 80 and connects with the handle 26 (FIG. 2) for operating the dispenser 20 as described below.

In one embodiment, a fill-hole 78 is formed through one housing segment 40 (FIG. 4) and preferably located to be normally covered by the baseball-cap-shaped handle 26. Manipulation of the handle 26 as described below will expose the hole 78 so that the housing interior chamber may be refilled with novelty items as needed.

Figure 3A:
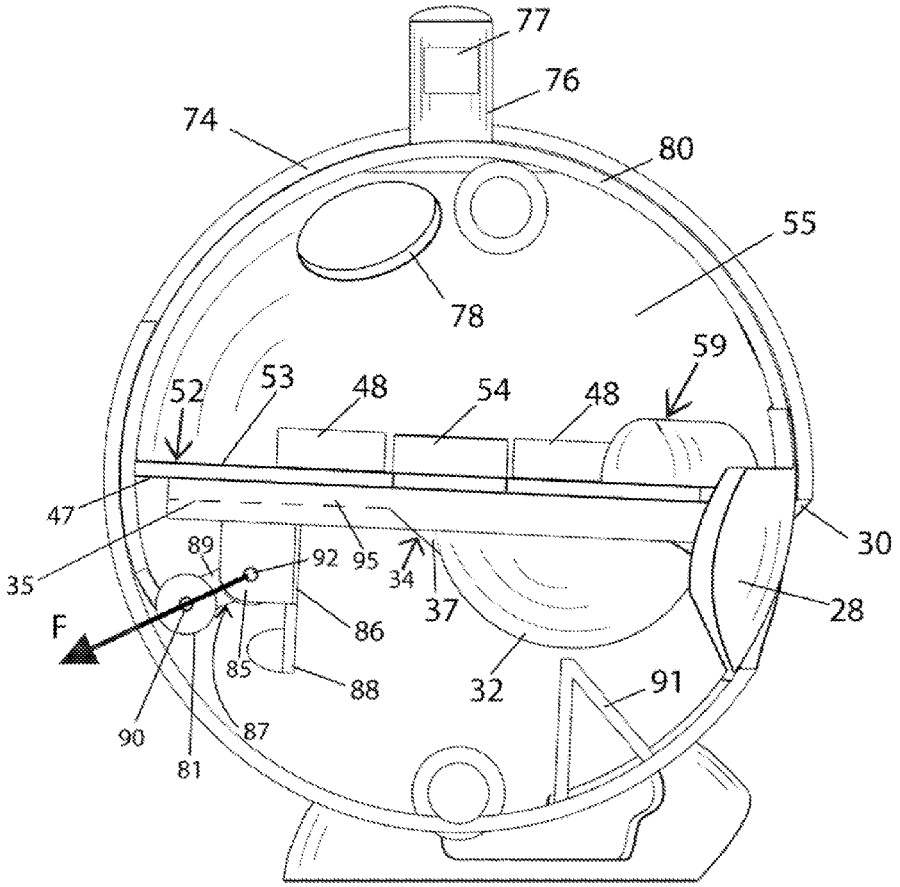
FIGS. 3A and 3B are side views, partly in cross section, revealing the interior of the dispenser housing and the parts contained therein.
Figure 3B:
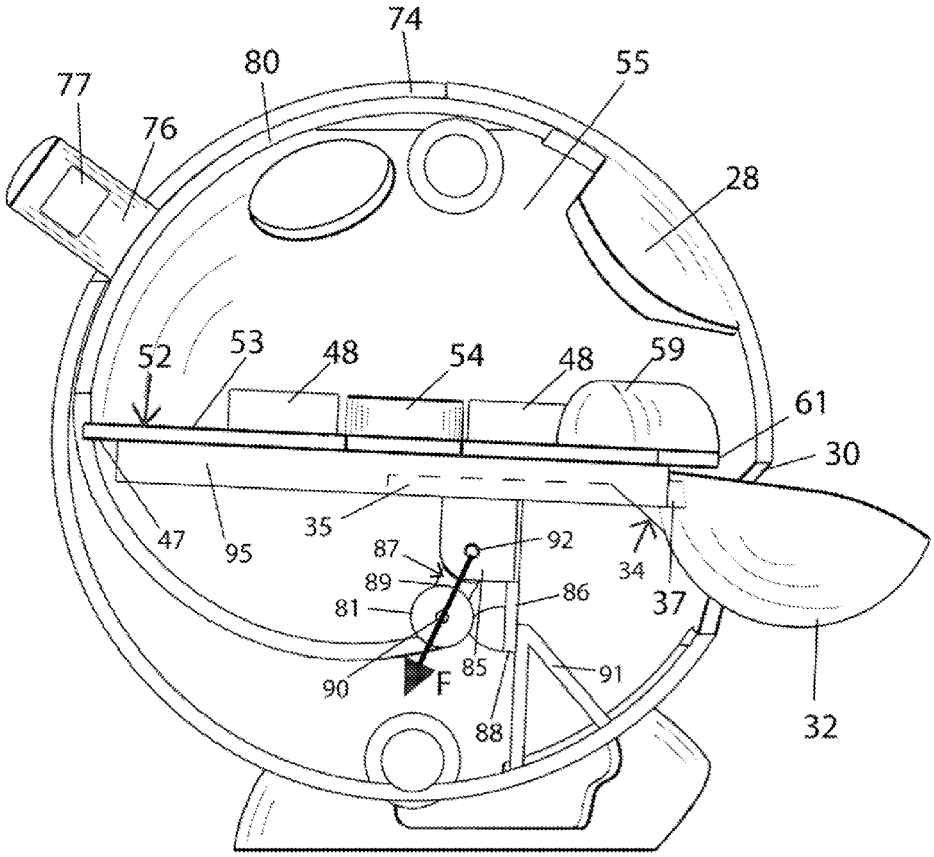

With reference especially to FIGS. 3A, 3B, 6, 7A and 7B, the above-described support plate 52 is shown in FIGS. 3A and 3B within the housing 22, retained in place by the brackets 48 and bosses 54 described above. The support plate 52 is a thin, generally flat, and preferably plastic member. The upper surface 53 of the support plate generally defines the bottom of a chamber 55 in the housing interior where there is stored the novelty items (not shown) that are introduced into the compartment via the fill-hole 78.

Figure 6:
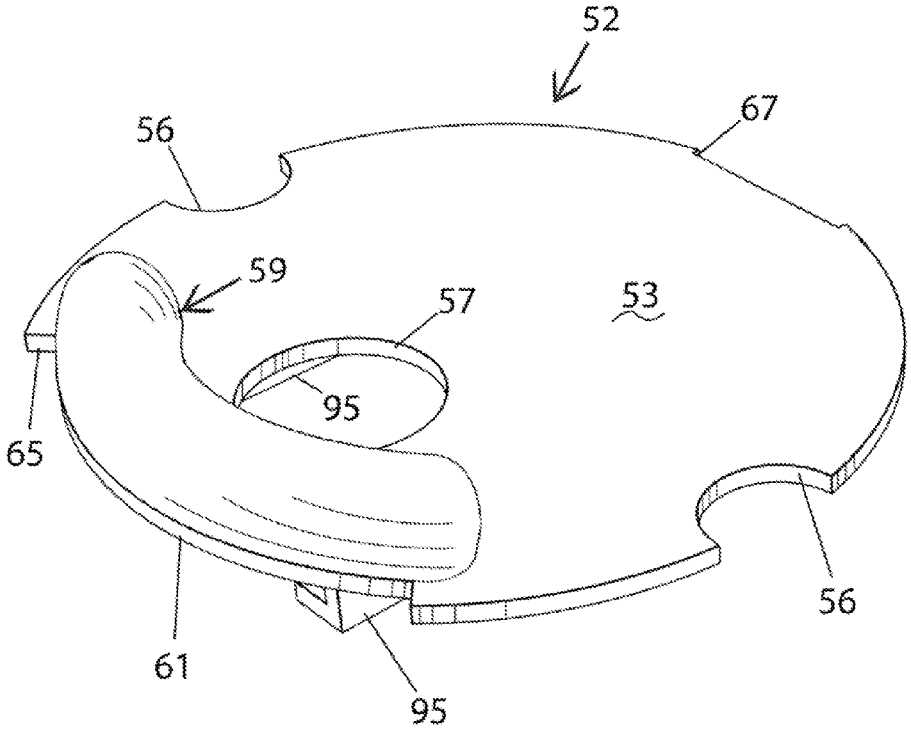
FIGS. 6 and 7A are respective top perspective and top plan views of a support plate component of the dispenser of the present invention.
Figure 7A:
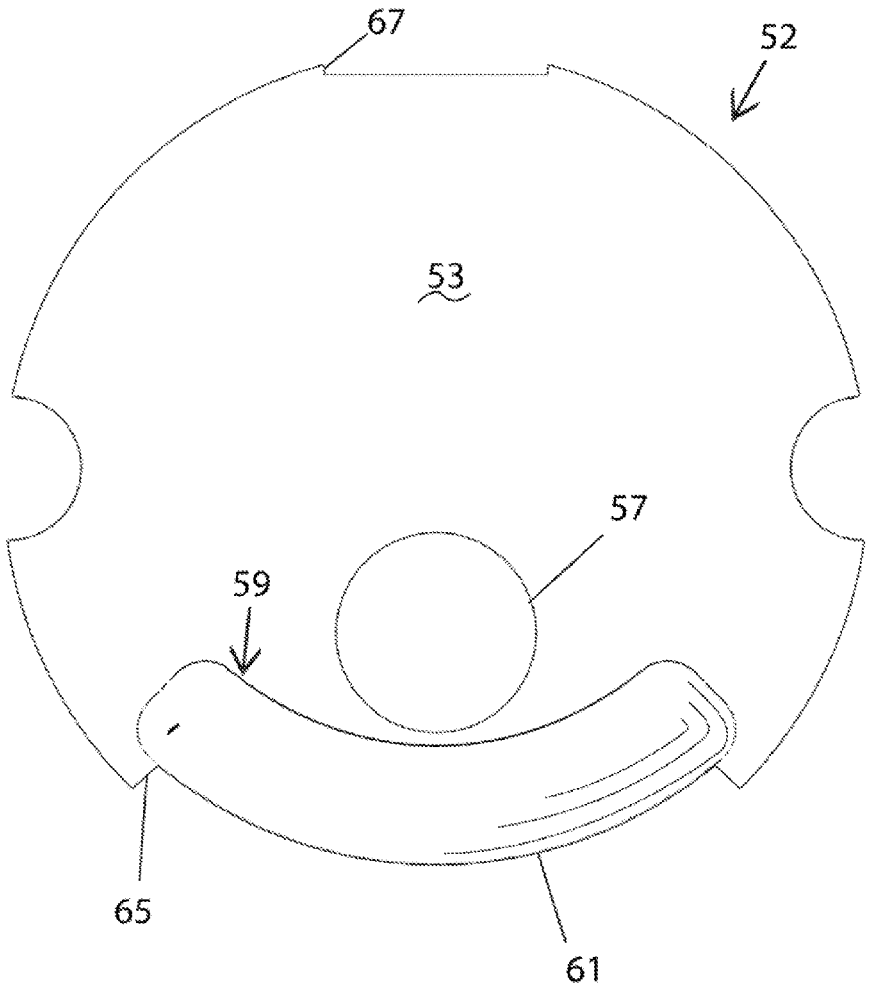
Figure 7B:
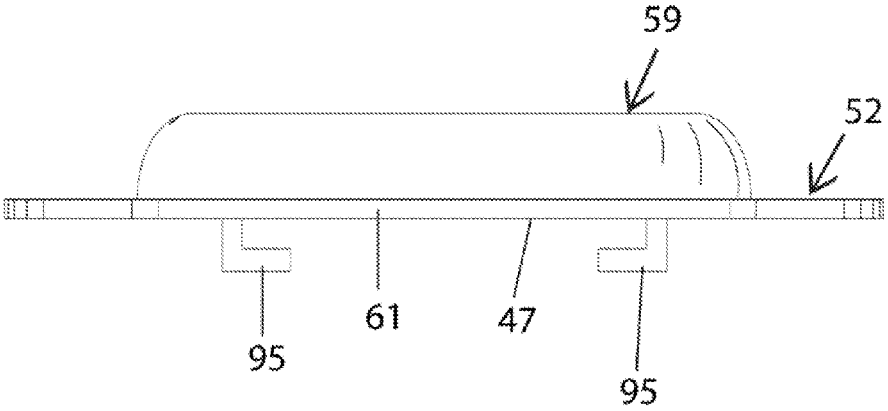
FIG. 7B is an end view of the support plate component of the dispenser.

The support plate 52 includes an aperture 57 though which individual novelty items pass to be dispensed from the apparatus (FIG. 6, 7A.) (Preferably, the aperture 57 and the above-mentioned receptacle member 34 are sized in correlation with the contained novelty items to dispense a single item at a time, although sizing for dispensing more than one item is certainly contemplated.) The aperture 57 is gated between open and closed states. When the aperture 57 is gated open, a novelty item is free to pass through the aperture 57 and into the bowl-shaped part 32 of the receptacle member 34.

To facilitate the movement of the items through the aperture 57, the upper surface 53 of the support plate 52 includes an upwardly protruding, generally crescent-shaped ridge 59 on the part of the support plate surface between the aperture 57 and the front edge 61 of the support plate (the front edge 61 of the support plate being the edge adjacent to the opening 30 in the housing wall. The side of the ridge 59 facing the aperture 57 is generally concave and angled so that items in contact with it are directed to the aperture 57 in a funnel-like action. It will be appreciated that the upper surface 53 of the support plate 52 can be otherwise contoured or configured to efficiently direct by gravity the novelty items toward the gated aperture 57.

The top of the ridge 59 is rounded. Moreover, the front edge 61 of the support plate includes a shallow recess 65 (FIGS. 6, 7A) facing the hole 30 in the housing. The recess provides clearance for the door 28 to slide between the support plate 52 and housing wall as it moves into the closed position. The rounded top of the adjacent ridge 59 (as well as the clearance provided by recess 65) ensures that the door will not become caught on the support plate 52.

At the back of the support plate 52 there is formed a clearance gap 67, configured somewhat like the above mentioned gap 66 to permit the thin, generally flat link member 80 to slide easily through the gap between the support plate 52 and housing wall without twisting. The structure and function of the link member 80 in operating the apparatus is described below.

The above-mentioned receptacle member 34 is mounted to the support plate 52 and slidably movable along the support plate from a retracted position within the housing (FIG. 3A) to an extended position (FIG. 3B) wherein the bowl-shaped part 32 of the receptacle member protrudes from the housing. The motion of the receptacle member 34 is driven by the link member 80 as discussed below.

In a preferred embodiment, the receptacle member 34 (See FIGS. 3A, 3B, and 9A-9C) comprises the bowl-shaped part 32 which is fixed to or part of the front end 37 (to the right in FIG. 3B) of a generally flat slide plate 35. The receptacle member can be releasably attached to the slide plate so that any of a variety of receptacle member sizes may be used, depending on the size of the novelty to be dispensed. The slide plate 35 includes side flanges 93 extending outwardly from each side of the slide plate 35 from the back end 39 of the slide plate 35 to the front end 37 adjacent to the bowl portion 32 of the receptacle member 34. With reference to FIGS. 9A, 3B, 7A and 7B, the flanges 93 fit between two downwardly facing channels 95 formed on the underside 47 of the support plate 52. Accordingly, the sliding motion of the slide plate 35 as the receptacle member 34 moves from the extended to the retracted poison is controlled and guided by this flange 93/channel 95 arrangement. It will be appreciated that with this configuration of the support plate 52 and underlying slide plate 35 there is desirable separation in the housing between the contained novelty items in the chamber 55, and the moving parts that operate to dispense the items, thus reducing the likelihood of jamming the device.

The upward facing surface of the slide plate 35 part of the receptacle member 34 is flat and parallel to the underside 47 of the support plate 52 and serves as a gate that moves across the aperture 57 in the support plate 52 to close the aperture once the novelty-item-carrying bowl-shaped part 32 of the receptacle member is moved to the extended position.

Upon moving back into the refracted position, the flat surface of the slide plate 35 moves away from the aperture 57, effectively opening the gate to permit another novelty item to fall into the bowl 32 as the bowl slides into the retracted position directly beneath the aperture.

Figure 8:
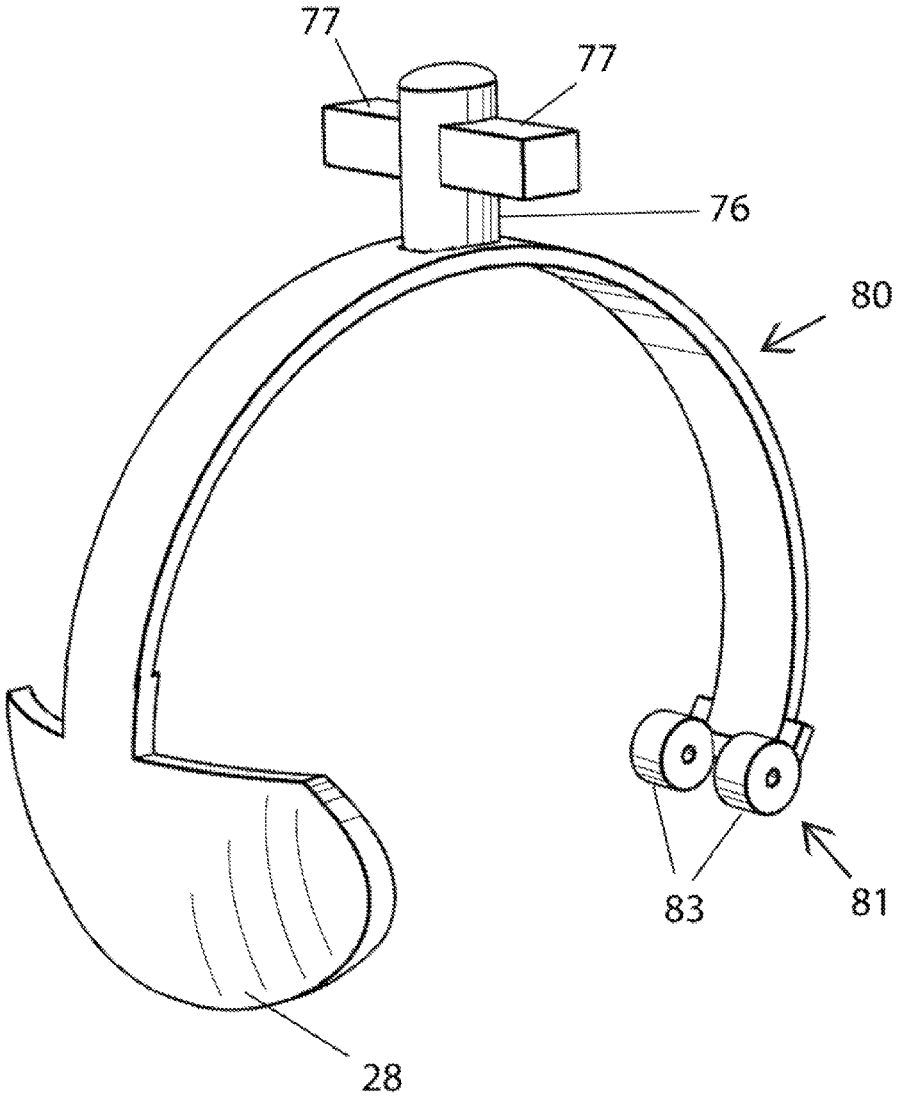
FIG. 8 is a perspective detail view of a link member component of the dispenser of the present invention.
Figure 9A:
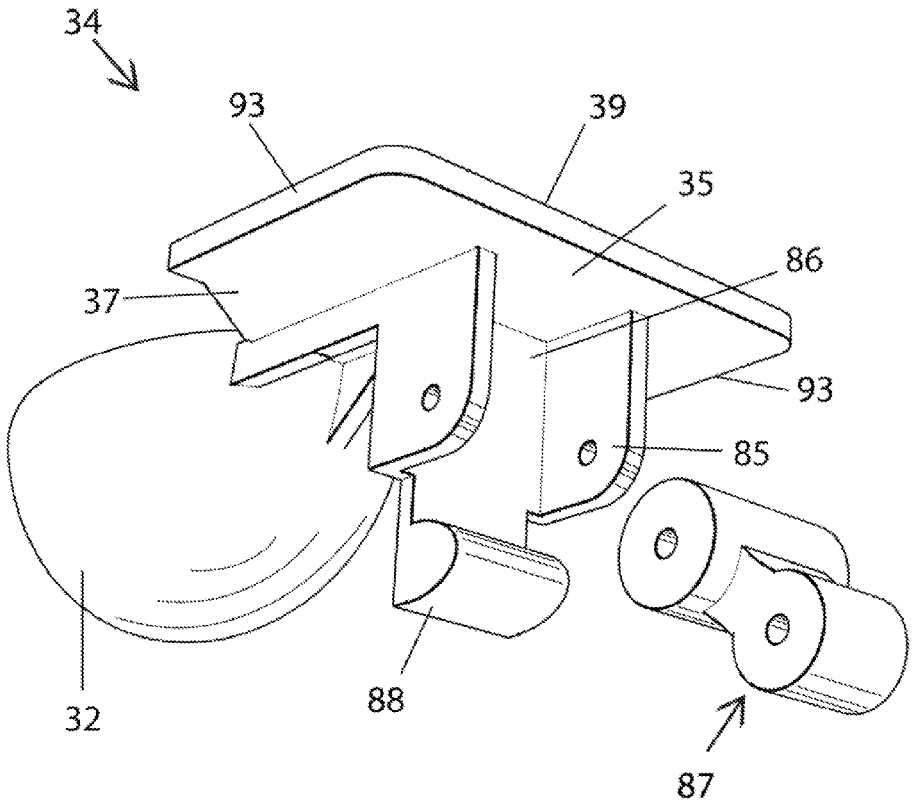
FIGS. 9A and 9B are respective rear perspective and side views of a receptacle member component of the dispenser of the present invention.
Figure 9B:
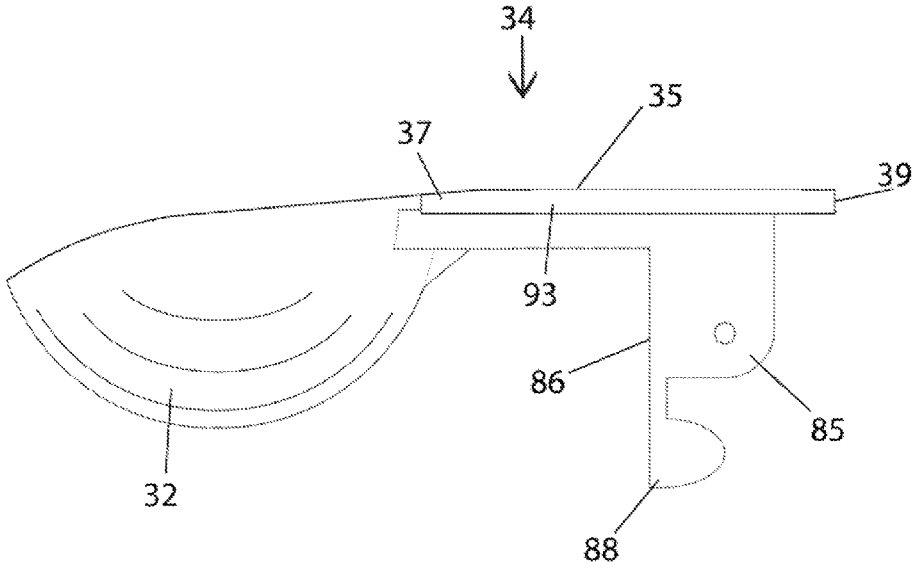
Figure 9C:
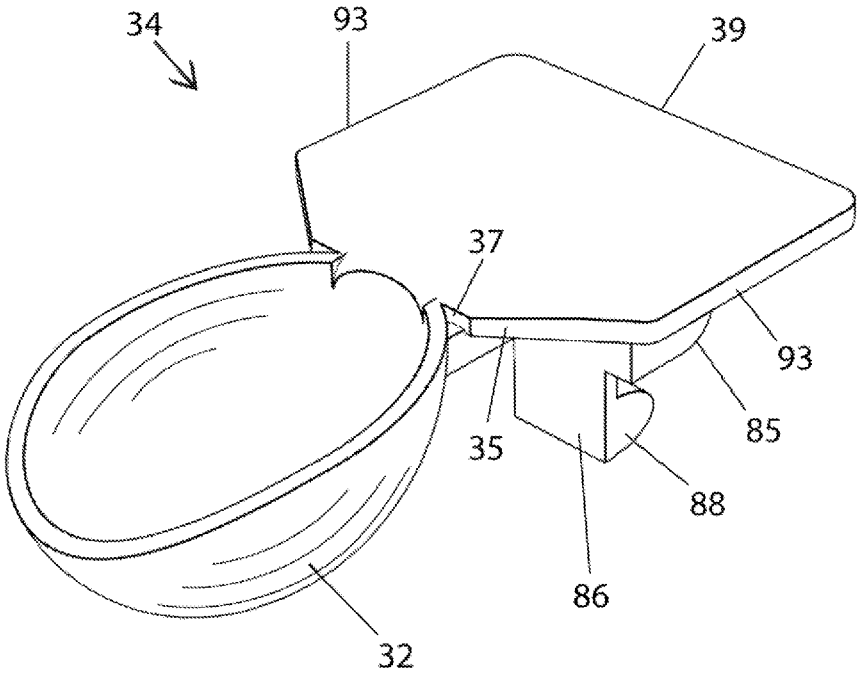
FIG. 9C is a front perspective view of the receptacle member component of the dispenser.

As shown in FIG. 8, in a preferred embodiment, the link member 80 is a thin, flexible member normally assuming an arcuate shape that, in this embodiment, generally conforms to the curvature of the interior surface of the spherical housing 22. The link member 80 is in whole or in part an elastic member that, when deformed, generates elastic force for returning the link member to its normal, arcuate configuration.

The door 28 is integrally formed with or attached at one end of the link member 80. The door is configured as a thin member that is curved to conform to the curvature of the interior surface 64 of the spherical housing 22. The door 28 is sized to completely occlude the opening 30 in the housing when the door is closed. Moreover, the edges of the door 28 are beveled to facilitate smooth motion of the door between the closed position (FIG. 1) and open position (FIG. 2), especially when the door moves to close with stored novelty items contacting it.

At the end of the link member 80 that is opposite the end carrying the door 28, the link member is formed into or has attached to it a hinge barrel 81 comprising two spaced apart hinge knuckles 83. This end of the link member 80 will be hereafter referred to as its hinged end.

Another hinge barrel 85 is formed in a bracket 86 that extends from the underside of the receptacle member slide plate 35. The barrel 85 is spaced away from the back end 39 of the slide plate. Between the knuckles 83 of the link member hinge barrel 81 is pinned a hinge member 87. The hinge member 87 (FIG. 9A) comprises a flat leaf 89 (FIGS. 3A and 3B) having a knuckle on each of the two opposing ends of the leaf. The hinge member 87 is pinned though one knuckle to the barrel 81 on the link member, and pinned through the other knuckle to the hinge barrel 85 of the slide plate 35 (See FIGS. 3A and 3B).

The resulting hinge configuration provides a floating hinge connection between the slide plate 35 and the link member 80 that, while behaving like a normal hinge, enables two parallel axes of rotation, such that one axis can be moved relative to the position of the other axis. This configuration provides, among other things, a useful lost-motion mechanism for the dispenser, as described next.

For the sake of discussion, and with particular reference to FIGS. 3A and 3B, the pivot axis that is defined by the pivot connection of the hinge barrel 81 and hinge member 87 will be hereafter referred to as the drive pivot axis 90. The pivot axis that is defined by the pivot connection of the hinge barrel 85 and hinge member 87 will be hereafter referred to as the follow pivot axis 92. As noted, those axes are separate and parallel. Also, for the sake of discussion, a line between and perpendicular to these pivot axes, will be considered as a line of action, shown via arrow "F" in FIGS. 3A and 3B, the significance of which is described below.

FIGS. 3A and 3B and 8 illustrate the post 76 that protrudes from the slot 74 in the upper part of the housing. As mentioned above, the post is exposed outside the housing and, in this embodiment, is attached to the handle 26. The handle is manipulated by the user to move the link member and, thus, the attached receptacle member between the retracted and extended position. The post 76 includes a pair of outwardly protruding studs 77 that are employed for attaching the post (hence, the link member) to the handle 26, as will be described later.

In order to extend the receptacle member 34 from the retracted position (FIG. 3A) to the extended position (FIG. 3B), the user simply pushes on the handle to which the post is fastened. As a result, the link member 80 slides along a path within the housing 22, generally around the interior surface 64 in a counterclockwise manner as respects FIGS. 3A and 3B. As soon as the link member 80 begins to move out of the closed position (FIG. 3A), the direct connection between the link member and the door 28 attached thereto results in the immediate movement of the door toward the open position.

On the other hand, the sliding motion of the receptacle member 34 toward the door 28 is conveniently delayed somewhat as the link member is initially moved. The delay is attributable to the operation of the floating hinge connection between the hinged end of the link member 80 and the slide plate 35. In particular, this connection introduces lost-motion such that the drive axis 90 of hinge barrel 81 swings counterclockwise (FIG. 3A) around and generally beneath the follow axis 92 of hinge barrel 85 on the slide plate 35, without causing the slide plate 35 to move. Thus, with movement of a single link member, the door 28 will immediately begin to open before the bowl-shaped part 32 of the receptacle member 34 begins to advance toward the door. It will be appreciated that this lost-motion action permits storing the receptacle member 34 (that is, in the retracted position) in a compact space very close to the door, while controlling movement of both door and receptacle member at different times but with the same, simple mechanical actuator (the post 76).

In a preferred embodiment, the slide plate 35 includes a stop 88 projecting from the bracket 86 on underside of the slide plate 35. The stop 88 is located to contact and thus limit the travel distance (toward the extended position) of the receptacle member 34. To this end, a bumper 91 is located inside the housing to contact the stop 88 at the end of the receptacle member travel to the extended position (FIG. 3B)

The stop 88 also limits the travel distance of the hinge barrel 81, which swings about hinge barrel 85 as the link member 80 is initially moved from the closed position. This abutting contact of the hinge barrel 85 and stop 88 is where the force applied to the link member 80 is transferred to the slide plate 35 for extending the receptacle member.

As noted earlier, the link member 80 is an elastic member, so that when deformed it generates elastic force for returning the link member to its normal, arcuate configuration. With reference to FIGS. 3A and 3B, the hinged end of the link member is directed by the path of the link member from a position where (FIG. 3A) the overall link member assumes its, normal, relaxed (i.e., not significantly deformed) configuration to a position (FIG. 3B) where the hinged end of the link member is deformed inwardly, toward the center of the housing 22. Put another way, the link member is deformed from an arcuate into a spiral configuration. The elastic force generated by the deformation of the hinged end passes through the line of action "F" mentioned above. This elastic force is employed to enhance operation of the dispenser, as discussed next.

As shown in FIG. 3B, when the receptacle member 34 is in the extended position, the hinged end of the link member is deformed, thus generating elastic force acting through the line of action "F." In the extended position, the line of action "F" is such that the elastic force provided to the slide plate 35 (as transmitted through the hinge leaf 89) tends to pull the slide plate 35 substantially downwardly, or downwardly and slightly toward the extended position. Also, at the other end of the link member, the door 28 and other parts of the link member are elastically urged against the interior of the housing, which results in friction force opposing the link member, while in the extended position, from returning to the retracted position. Consequently, this elastic force of the link member 80 tends to secure the receptacle member 34 in the extended position after the link member is slid by the user into that position. Thus, the user can both extend the receptacle member (and the item carried in the bowl-shaped part 32) and retrieve the item with a single hand. The dispenser will not automatically snap shut.

As the user then closes the dispenser by moving the post 76 (via attached handle 26) back toward the fully retracted position of the receptacle member shown in FIG. 3A, the path of the link member is such that the hinged end thereof remains deformed somewhat, thus maintaining the elastic force through the line of action "F." The link member 80 and path are configured so that as the receptacle member approaches the fully retracted position, the angle between the line of action "F" and the direction of the sliding, retracting slide plate 35 steadily diminishes until the component of the elastic force acting in the direction of retraction (to the left in FIG. 3A) increases by an amount sufficient to force the receptacle member into the full, retracted position, in the absence of user manipulation. Thus provided is a useful "toggle" or snap-shut feature for assisting with full retraction of the receptacle member 34 and coincident secure closing of the door 28.

It will be appreciated that the path of the hinged end of the link 80 can be configured so that the magnitude of the elastic force and its line of action "F" as the receptacle member approaches the extended position are such that the receptacle member tends to conveniently snap to the fully open or extended position.

Figure 10:
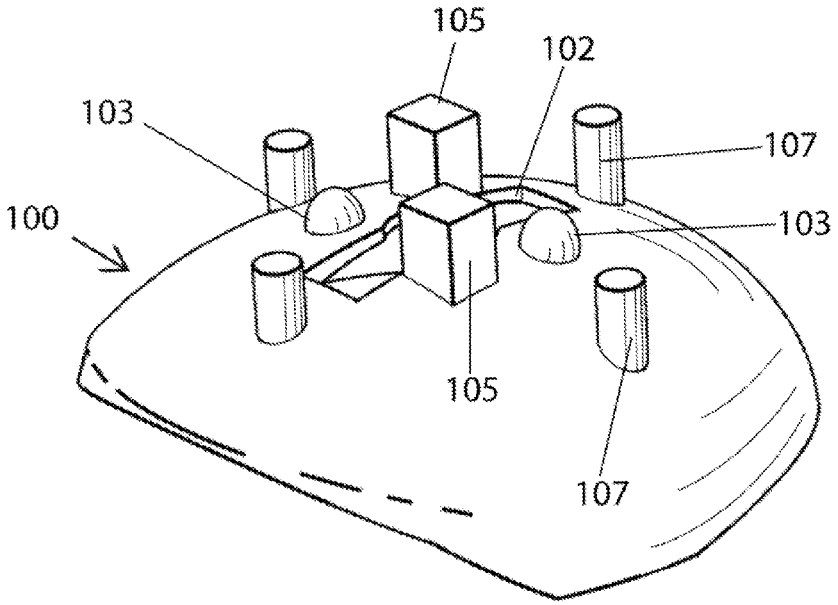
FIG. 10 is a perspective, detail view of a fastener component of the dispenser.

FIG. 10 illustrates one embodiment of a fastener 100 for securing the exposed, protruding post 76 to the handle 26. The fastener 100 has an underside that is shaped (in this embodiment, a concave curve, to conform to the curvature of the exterior surface of the housing 22, thus permitting the fastener to smoothly slide over the housing. An elongated passage 102 through the fastener 100 is shaped to allow the post 76 and protruding studs 77 to pass through. Once through, the fastener is rotated (clockwise in FIG. 10) until the studs snap over detent bumps 103 to be received in spaces between those bumps 103 and relatively larger stops 105. The fastener thickness is, relative to the length of the protruding post 76, such that the studs will snap fit into place to capture the post, and require deliberate manual twisting to return into alignment with the opening to release the post.

Figure 11:
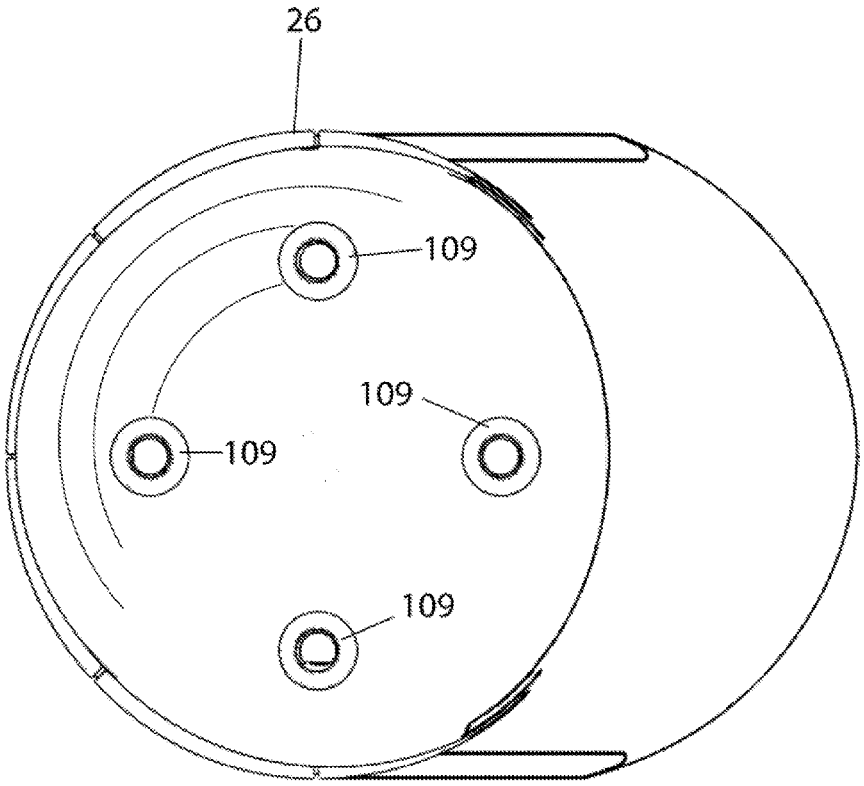
FIG. 11 is a bottom view of one preferred embodiment of an ornamentation that is attached to the fastener for manipulation by the user of the novelty dispenser.

Cylindrical pins 107 protrude upwardly from the fastener to snap-fit into correspondingly shaped holes 109 in the underside of the handle 26 (FIG. 11), thus to secure the handle 26 to the post 76 via the fastener 100.

The dispenser operation enhances the ways in which the device can be ornamented. For example, as shown in FIGS. 1 and 2, the outer surface of the door 28 can be illustrated with teeth, etc, while the bowl-shaped part 32, which is only visible when extended, can be colored or shaped to resemble a tongue. Moreover, the size of the door 28 can be enlarged considerably and moved behind additional openings or windows in the housing to alternately hide and reveal different imagery (closed eyes, logos, etc) as the door is moved by the link member into and out of the closed position.

There are several ways to access the fill-hole that is formed through the housing wall in addition to removing the handle. One specific example is to provide the handle (baseball cap) with a flap that can be opened to reveal the underlying fill hole. The fill hole can also be made directly through the housing, with a flap cover. It is noteworthy that the fill hole permits the manufacture and filling of the dispenser to occur and two separate locations.

Also, to enlarge the available space for storing items in the housing, the support plate 52 could be bowl shaped and located near the curved bottom of the housing interior, with the receptacle member being jointed or otherwise made flexible to fit into the curved space between the underside of the curved support plate and the bottom of the housing interior.

FIGS. 12-19 depict an alternative embodiment of a novelty dispenser formed in accordance with the present invention.

Figure 12:
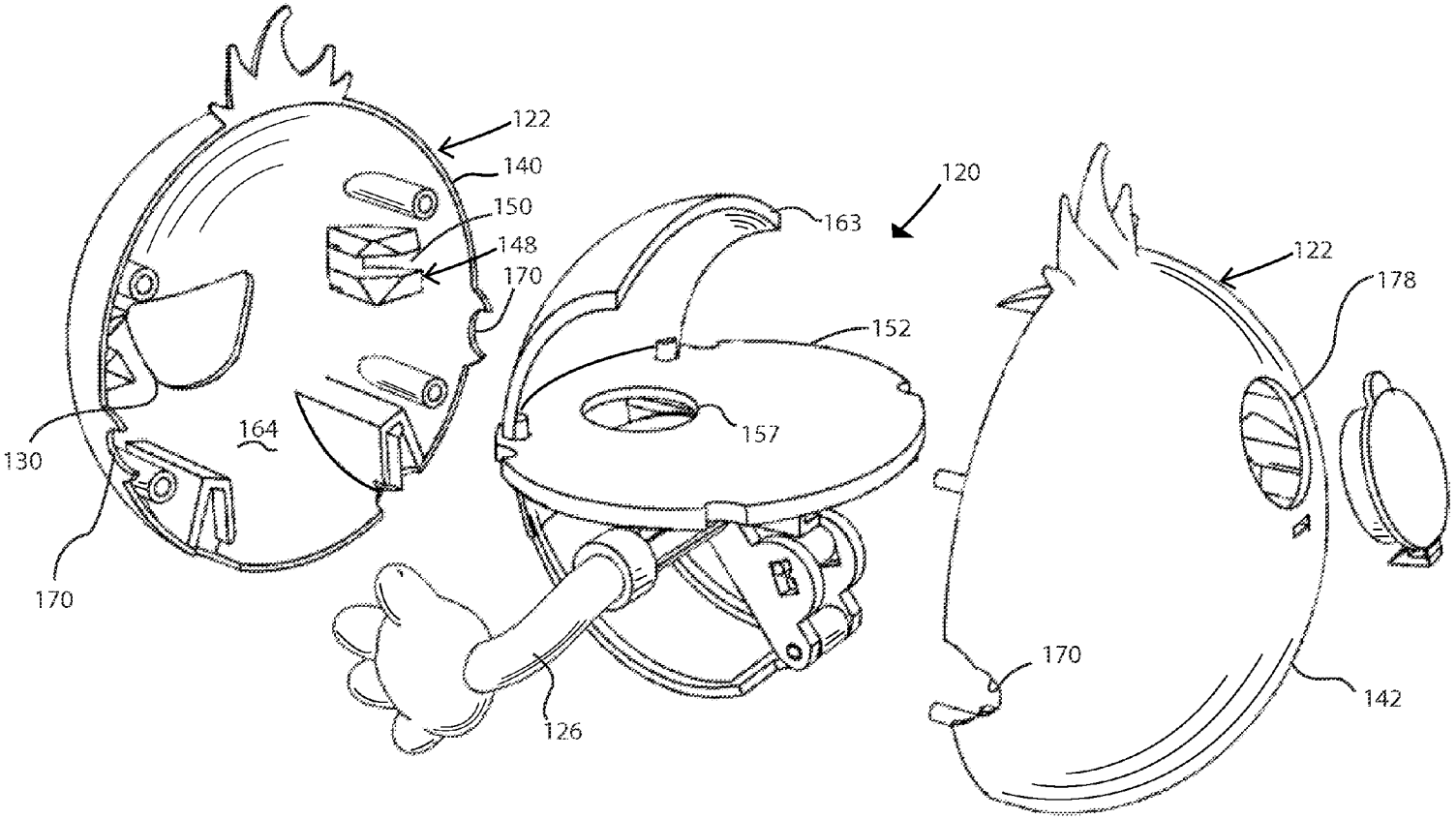
FIG. 12 is a partly exploded view of an alternative embodiment of a novelty dispenser made in accordance with the present invention.
Figure 13:
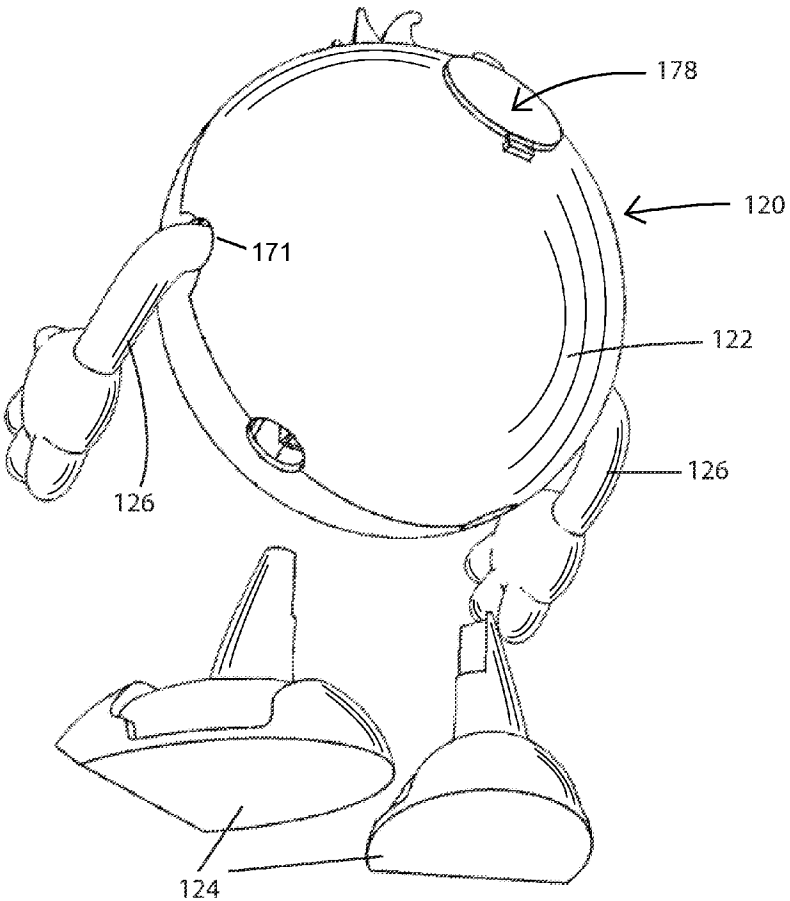
FIG. 13 is perspective view from below of a partly assembled novelty dispenser of FIG. 12.

As shown in FIGS. 12-13, the alternative embodiment of the novelty dispenser 120 includes a housing 122, which like the prior embodiment is a thin-walled, plastic, generally spherical member resulting from the assembly of two segments 140, 142. The housing is supported by a base 124, which in this embodiment is configured as two cartoon-like feet.

Figure 19:
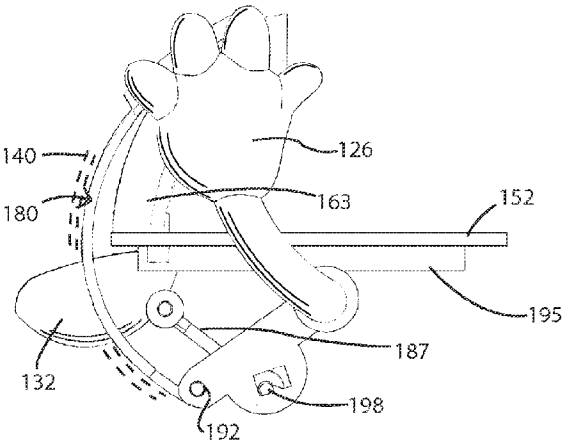

Protruding from opposing sides of the housing 122 are handles 126 for operating the dispenser. In this embodiment, the handles are configured as cartoon-like arms. The handles 126 are fastened to the internal components of the housing, as described more below, and are movable from a closed position (see FIG. 16) to a dispense position (FIG. 19). As the handles 126 are moved to the dispense position, the dispenser operates to raise a door 128 (see FIGS. 14-15) to reveal an opening 130 (FIG. 12) in the housing wall through which extends the bowl-shaped part 132 of a receptacle member 134 that carries one or more novelty items for the user to take.

A fill-hole with removable cap 178 is formed through one housing segment 142 (FIG. 12). The fill-hole 178 permits refilling of the housing interior chamber with novelty items as needed.

With reference to FIG. 12, the inside of each housing segment 140, 142 includes a pair of spaced-apart brackets 148. Each of the pair of brackets defines a groove 150 into which fits a thin, horizontal support plate 152 that is contained within the housing.

The housing interior includes a guide member 163 that is mounted to the edge of the support plate 152, as shown in FIG. 12. The guide member 163 is spaced slightly from the curved interior surface 164 of the housing to define between them a gap into which slides the door 128 as it is raised into the dispense position (FIG. 19).

With reference to FIGS. 12 and 13, the housing segments 140, 142 are both formed with generally semi-circular recesses 170 at the edge of the housing segment. When the housing segments are assembled together, the combined recesses 170 form an aperture 171 on opposite sides of the housing. A handle 126 protrudes through each aperture 171.

Figure 14:
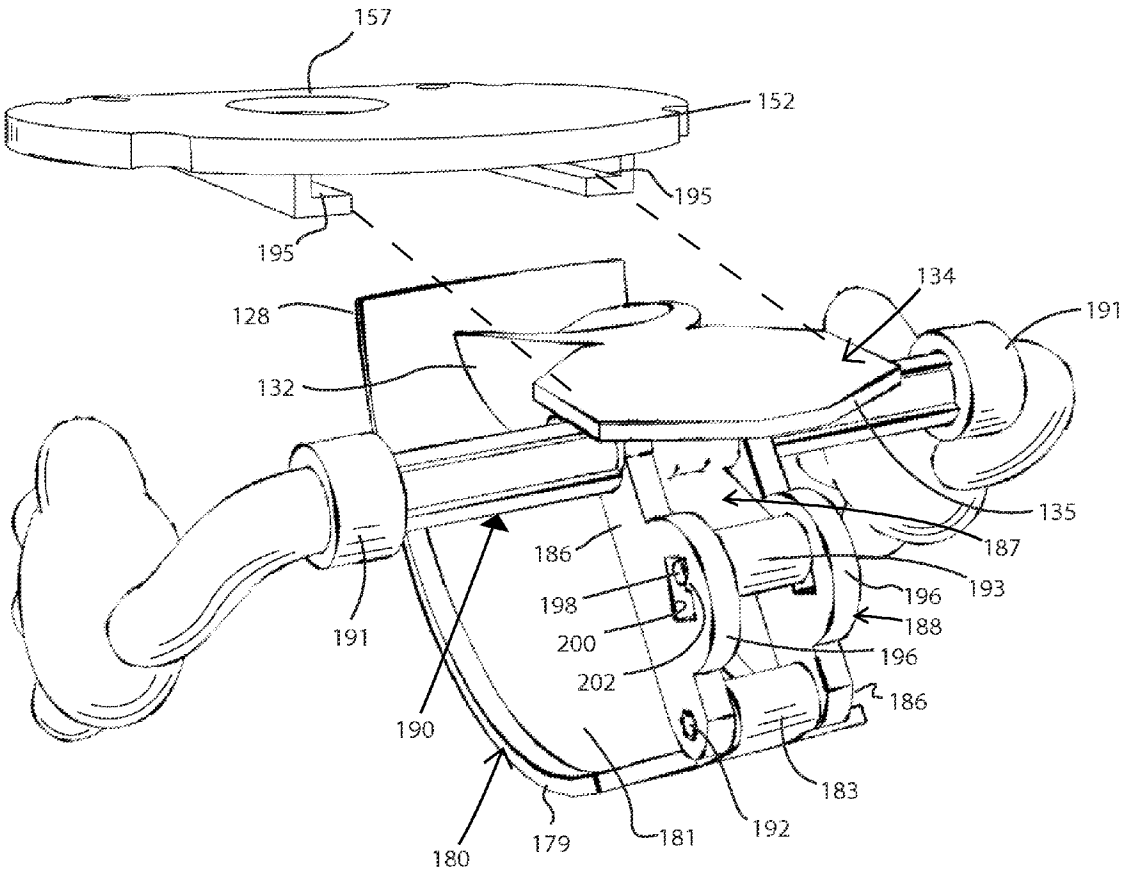
FIG. 14 is an enlarged, detail view of components contained within the housing of the embodiment of FIG. 12.
Figure 15:
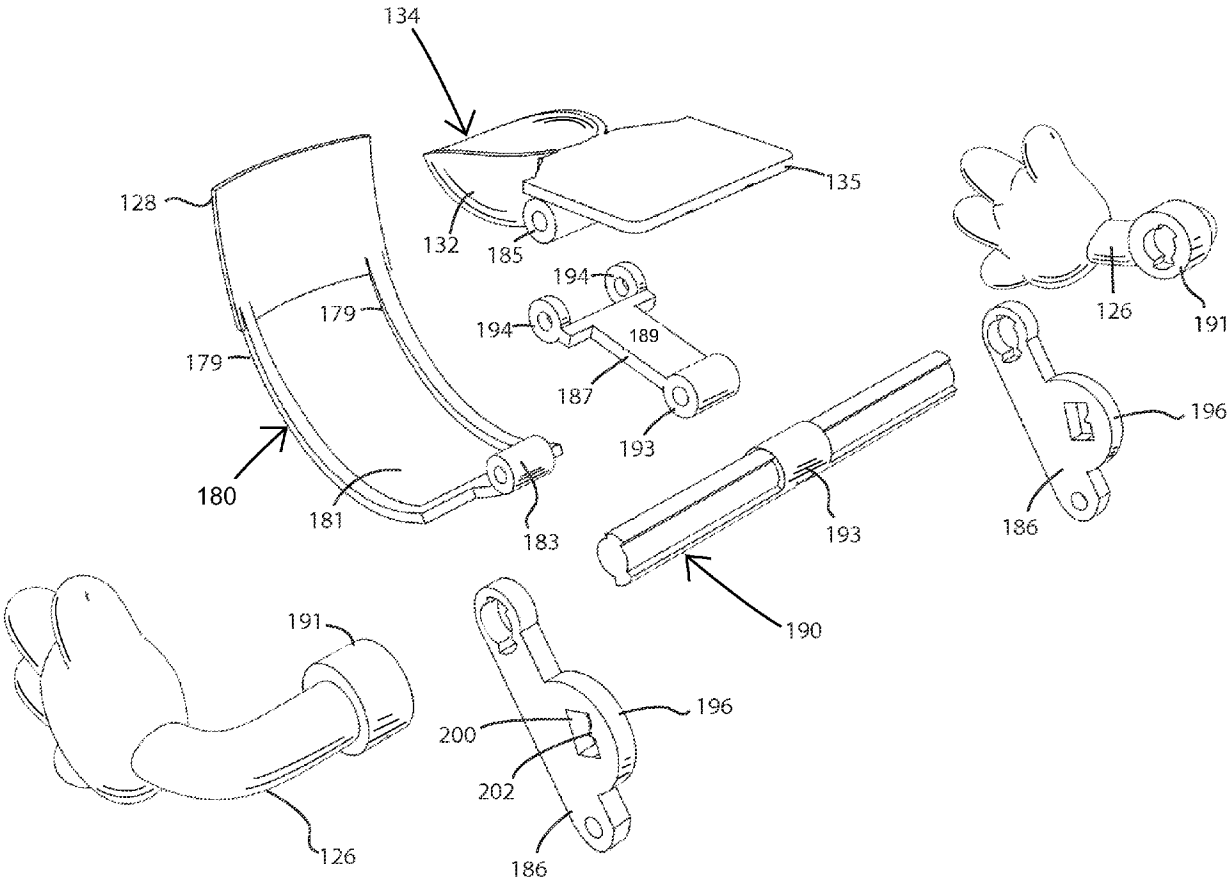
FIG. 15 is an exploded view of the primary internal components of the embodiment of FIG. 12
Figure 17:
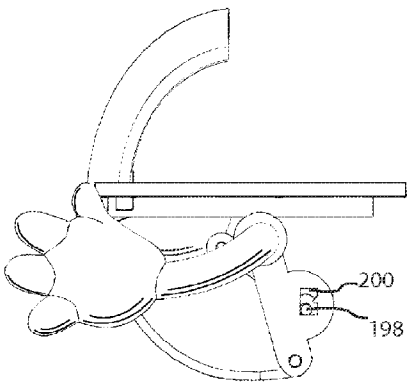
FIGS. 16-19 are a sequence of side views of the internal components of the embodiment of FIG. 12 as those components are operated, when secured within the housing, to move from a closed position (FIG. 16) to a dispense position (FIG. 19).

As best shown in FIGS. 14 and 15, each handle 126 is attached to the end of a splined shaft 190 for operating the dispenser 120 as described below. Bushings 191 are formed at the junction of the handle 126 and each end of the splined shaft 190. Each bushing 191 fits just inside a corresponding aperture 171 in the housing. The spined shaft 190 is thus mounted inside the housing for rotation about its long axis, but restrained against axial or translational motion in the housing. The splined shaft 190 is an internal component of the dispenser, manipulated by the handles 126 as explained more below.

The above-mentioned support plate 152 includes an aperture 157 though which individual novelty items pass to be dispensed from the apparatus. The aperture 157 (FIGS. 12, 14) is gated between open and closed states. When the aperture 157 is gated open, a novelty item is free to pass through the aperture and into the bowl-shaped part 132 of the receptacle member 134.

As was described with respect to the prior embodiment, the front edge of the support plate 152 includes a shallow recess that faces the opening 130 in the housing. The recess provides clearance for the door 128 to slide between the support plate 52 and housing wall as it moves into the closed position. The guide member 163 ensures that the door 128 will not become caught on the support plate 152 or novelty items that may be stored in the dispenser.

The receptacle member 134 is mounted to the support plate 152 and slidably movable along the support plate from the retracted position within the housing (FIG. 16) to an extended position (FIG. 19) wherein the bowl-shaped part 132 of the receptacle member protrudes from the housing (partially shown at 140 in dashed lines, FIG. 19). The bowl-shaped part 132 of the receptacle extends from a flat slide plate 135. The slide plate 135 has straight side edges that fit between two downwardly facing channels 195 formed on the underside of the support plate 152. Thus, the sliding motion of the slide plate 135 as the receptacle member 134 moves from the extended to the retracted position is controlled and guided by this flange and channel arrangement.

As with the prior embodiment, the slide plate 135 serves as a gate that moves across the aperture 157 in the support plate 152 to close the aperture once the novelty-item-carrying bowl-shaped part 132 of the receptacle member is moved to the extended position. Upon moving back into the retracted position, the flat surface of the slide plate 135 moves away from the aperture 157, effectively opening the gate to permit one or more additional novelty items to fall into the bowl 132.

As best shown in FIG. 15, the door 128 is integrally formed with or attached at one end of a pair of spaced apart arms 179 of a link member 180. The door 128 is configured as a thin member that is curved to conform to the curvature of the interior surface of the housing 122. The door 128 is sized to completely occlude the opening 130 in the housing when the door is closed.

At the end of the link member 180 that is opposite the end carrying the door 128, the link member arms 179 join and form a hinge knuckle 183. As shown in FIGS. 14 and 15, the link member 180 thus defines a generally rectangular window 181 through which extends the bowl-shaped part 132 of the receptacle member 134 as the door 128 moves upwardly, thereby providing clearance for the bowl-shaped part 132 to extend out of housing opening 130 for dispensing the novelty item.

As shown in FIG. 15, in a preferred embodiment, the link member 180 is a thin, flexible member normally assuming an arcuate shape that, in this embodiment, generally conforms to the curvature of the interior surface of the spherical housing 122. The link member 180 may be rigid. Alternatively, the link member 180 is in whole or in part an elastic member that, when deformed, generates elastic force for returning the link member to its normal, arcuate configuration.

As shown in FIG. 14, the hinge knuckle 183 is pinned (at 192) between the lower ends of a pair of generally flat leaves 186 of a link bracket 188. The upper ends of the leaves have holes that are keyed to match the spline configuration of the spined shaft 190. Each one of the leaves 186 is slid over an end of the shaft to abut a central portion 193 of the shaft 190 (FIG. 15) that is not keyed or splined. With this configuration the link bracket 188 is affixed to and rotates with the shaft 190 whenever that shaft is rotated about its long axis by the user lifting or lowering the handles 126 between the closed position (FIG. 16) and the dispense position (FIG. 19).

A hinge barrel 185 is formed on the underside of the bowl-shaped part 32 of the receptacle member spaced slightly away for where the slide plate 135 joins the bowl-shaped part 132. The barrel 185 is pinned to a hinge member 187. The hinge member 187 (FIG. 15) comprises a flat leaf 189 having two hinge knuckles 194 on one end and a single knuckle 193 on the other end of the leaf. The hinge member 187 is pinned through the pair of knuckles 194 to the hinge barrel 185 on the underside of the bowl-shaped part 132.

At the other end of the hinge member 187, the single hinge knuckle 193 is pinned between central enlargements or tabs 196 formed on each leaf of the link bracket 186. In this embodiment, the opposite ends of a pivot pin 198 extend from the hinge barrel 193 and are received within a keyway 200 formed through each tab 196 The opposite ends of the pivot pin 198 can move slightly within the keyways 200 for permitting a useful lost-motion mechanism for the dispenser operation as described below.

To operate the dispenser, one or both handles 126 are manipulated by the user to rotate the splined shaft 190, with affixed link bracket 188, to thus move the link member 180 and attached door 128 from the closed position (FIG. 16) to the fully open position (FIG. 19). The receptacle member 134 is somewhat simultaneously moved between the retracted and extended position.

Specifically, to extend the receptacle member 134 from the retracted position (FIG. 16) to the extended position (FIG. 19), the user simply pushes upwardly on the handle 126 to which the shaft 190 is fastened. As a result, the link member 180 slides along a path within the housing, generally around the interior surface 164 (FIG. 12) in a clockwise manner as respects FIGS. 16-19. As soon as the link member 180 begins to move out of the closed position (FIG. 16), the direct connection between the link member and the door 128 attached thereto results in the immediate movement of the door toward the open position.

Figure 16:
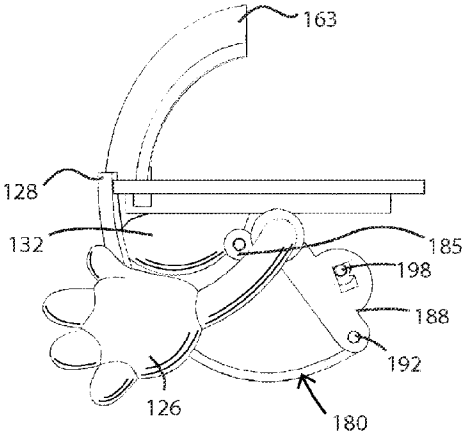
Figure 18:
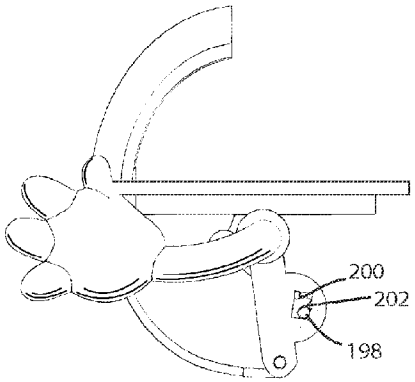

On the other hand, the sliding motion of the receptacle member 134 toward the opening 130 in the housing is conveniently delayed somewhat as the link member 180 is initially moved. The delay is attributable to the limited floating operation of the pivot pin 198 within the keyways 200 of the tabs 196 of the link bracket 188. In particular, this connection introduces lost-motion such that the pivot pin 198 is free to slide generally counterclockwise along one edge of the keyway 200 as the handle is manipulated to begin rotation of the splined shaft 190 and attached link bracket 188 out of the retracted position (FIG. 16). As the shaft continues to rotate, the pivot pin 198 slides in the keyway to a drive position (FIG. 18) where the pin 198 encounters an inwardly protruding stop 202 in the keyway 200 that prevents further sliding. From this point forward, the rotating motion of the link bracket 188 is transferred directly to the receptacle member 134 via the hinge member 187. Thus, with movement of the handle 126, the door 128 will immediately begin to open before the bowl-shaped part 132 of the receptacle member 134 begins to advance toward the opening 130 that is revealed by the moving door 128.

As noted earlier, the link member 180, in particular the arms 179, may be an elastic member, so that when deformed it generates elastic force for returning the link member to its normal, arcuate configuration. With reference to FIGS. 16-19, the door 128 (which is an extension of the link member 180) continuously engages and slides against the curved surface of the inner guide member 163. The curvature of the guide member 163 is such that the radius of curvature of the guide member surface is slightly longer than that of the arcuate link member. As a result, the link member is slightly deformed out of its true arcuate configuration, and the elastic force generated by the deformation of the link member in reaction to this deformation is directed radially inwardly along a line of action from the hinge pin 192 toward the center of curvature of the link member 180.

Accordingly, when the receptacle member 134 is in the retracted position (FIG. 16), the deformed link member elastic force acting through the link bracket 188 urges counterclockwise rotation of the link member 180, hence tending to secure the door in the closed position in the absence of manipulation of the handles by the user. Similarly, when the receptacle member 134 is in the extended position (FIG. 19) the deformed link member elastic force acting through the link bracket 188 urges clockwise rotation of the link member 180, hence tending to secure the door 128 in the open position in the absence of manipulation of the handles by the user. Thus, the mechanism provides a useful toggle feature for assisting with full retraction and extension of the receptacle member 134.

While the foregoing description was made in the context of preferred embodiments, it is contemplated that modifications to those embodiments may be made without departure from the invention as claimed.

The invention claimed is:

1. A novelty dispensing apparatus, comprising:

a housing including a chamber in which novelty items may be contained;

a receptacle member slidably mounted inside the housing and movable from a retracted position within the housing, through an opening in the housing and into an extended position wherein a part of the receptacle member protrudes from the housing opening;

a door inside the housing and mounted for sliding movement inside the housing across the opening from a closed position to an open position that enables the part of the receptacle member to protrude from the opening;

a link member mounted for movement within the housing and attached at one end to the door and at another end to the receptacle member, the link member connected to a handle member for manipulation, wherein manipulation of the handle member moves the link member and attached door and receptacle member;

a lost-motion mechanism connected to the link member and receptacle member for delaying motion of the receptacle member until the door is moved partly out of the closed position;

a toggle mechanism connected to the receptacle member for forcing the receptacle member into either of the extended position or the retracted position in the absence of manipulation of the handle member as the receptacle member moves toward respective extended or retracted positions; and wherein at least a portion of the link member is elastic and guided for movement in the housing in a deformed configuration, thereby to provide an elastic force of the toggle mechanism.

2. The apparatus of claim 1 wherein at least a portion of the link member is deformable for providing the elastic force for forcing the receptacle member into the extended position and the retracted position.

3. The apparatus of claim 1 wherein the link member defines a window through which extends the part of the receptacle member that protrudes from the housing opening.

4. The apparatus of claim 1 wherein the link member is configured so that the receptacle member is secured in the extended position in the absence of the handle being manipulated by a user, thereby enabling single-handed operation of the dispensing apparatus such that the user can with the same hand move the receptacle member into the extended position and retrieve an item carried in the part of the extended receptacle member.

5. The apparatus of claim 1 wherein the lost-motion mechanism includes a floating hinge connection between the link member and receptacle member.

6. The apparatus of claim 1 wherein the link member is flexible, the apparatus further including a guide member within the housing for guiding bending movement of the link member within the housing.

7. The apparatus of claim 6 wherein the guide member is located near an interior surface of the housing, thereby defining a gap through which the flexible link member moves, the gap being sized to constrain the link member against twisting during movement.

8. The apparatus of claim 1 wherein the handle member comprises a handle fastened to a post by a fastener that engages the post, the fastener being configured to slide along the exterior of the housing as the handle member is manipulated.

9. The apparatus of claim 8 wherein the fastener is rotatable into a locked position for engaging the post and includes detent members for resisting rotational motion of the fastener out of the locked position.

10. The apparatus of claim 1 wherein the handle member is attached to a rotatable shaft that is pivotally connected to both the link member and to the receptacle member, the pivotal connection including a keyway in which a pivot pin is slidable as part of the lost motion mechanism.

11. A novelty dispensing apparatus, comprising:

a housing including a chamber in which novelty items may be contained;

a receptacle member slidably mounted inside the housing and movable from a retracted position within the housing, through an opening in the housing and into an extended position, wherein a part of the receptacle member protrudes from the housing opening;

a door mounted for movement adjacent to the opening from a closed position to an open position that enables the receptacle member to protrude from the opening;

a link member mounted for movement within the housing and attached at one end to the door and at another end to the receptacle member, the link member connected to a handle member for manipulation, wherein manipulation of the handle member moves the link member and attached door and receptacle member; and a toggle mechanism connected to the receptacle member for providing an elastic force for forcing the receptacle member into the retracted position in the absence of manipulation of the handle member as the receptacle member moves toward the retracted position, and wherein the elastic force increases as the receptacle member moves toward the retracted position.

12. The apparatus of claim 11 wherein at least a portion of the link member is elastic and deformable for providing the elastic force for forcing the receptacle member into the extended position and the retracted position.

13. The apparatus of claim 12 wherein the link member is configured so that the receptacle member is secured in the extended position in the absence of the handle being held or otherwise manipulated by a user so that the receptacle member remains in the extended position until the handle is manipulated to retract the receptacle member.

14. The apparatus of claim 11 further comprising a lost-motion mechanism connected to the link member and receptacle member for delaying extension movement of the receptacle member until the door is moved partly out of the closed position.

15. The apparatus of claim 11 wherein at least a portion of the link member is elastic and guided for movement in the housing in a deformed configuration, thereby to provide the elastic force.

16. A method for dispensing novelty items, comprising the steps of:

containing the novelty items in a chamber of a housing;

moving a slidably mounted receptacle member in a first direction from a retracted position within the housing, through an opening in the housing and into an extended position wherein a part of the receptacle member protrudes from the housing opening;

sliding a door that is mounted inside the housing in a direction substantially across the first direction so that the door slides across the opening from a closed position to an open position that enables the receptacle member to protrude from the opening;

elastically forcing the receptacle member into either of the extended position or the retracted position as the receptacle member moves toward respective extended or retracted positions by increasing the elastic force as the receptacle member moves toward respective extended or retracted positions; and delaying motion of the receptacle member until the door is slid partly out of the closed position.

17. The method of claim 16 including the step of elastically forcing the receptacle member into both the retracted and extended position; and connecting to the receptacle an elastic and deformable link member for providing the elastic force.

* * * * *